US005575849A

United States Patent [19]

Honda et al.

[11] Patent Number: 5,575,849

[45] Date of Patent: Nov. 19, 1996

[54] APPARATUS FOR PRODUCING A SUBSTRATE HAVING A SURFACE WITH A PLURALITY OF SPHERICAL DIMPLES FOR PHOTOCONDUCTIVE MEMBERS

[75] Inventors: Mitsuru Honda, Tokyo; Takahisa Kawamura, Yokohama; Atsushi Koike, Chiba; Keiichi Murai, Kashiwa, all of Japan

[73] Assignee: Canon Kabushiki Kaisha, Tokyo, Japan

[21] Appl. No.: 232,430

[22] Filed: Apr. 21, 1994

Related U.S. Application Data

[63] Continuation of Ser. No. 64,350, May 20, 1993, abandoned, which is a continuation of Ser. No. 949,358, Sep. 23, 1992, abandoned, which is a continuation of Ser. No. 826,634, Jan. 23, 1992, abandoned, which is a continuation of Ser. No. 440,676, Nov. 24, 1989, abandoned.

[30] Foreign Application Priority Data

Nov. 25, 1988 [JP] Japan ..... 63-296210

[51] Int. Cl.[6] ..... B05C 5/00; B05B 13/02

[52] U.S. Cl. ..... 118/44; 118/303; 118/320

[58] Field of Search ..... 118/102, 107, 118/303, 320, 44

[56] References Cited

U.S. PATENT DOCUMENTS 4,773,244 10/1988 Honda et al. ..... 118/107

*Primary Examiner*—Donald E. Czaja

*Assistant Examiner*—Steven P. Griffin

*Attorney, Agent, or Firm*—Fitzpatrick, Cella, Harper & Scinto

[57] ABSTRACT

An apparatus for producing a substrate having a surface with a plurality of spherical dimples suitable for light receiving members including: a cylindrical rotating vessel having an external wall face and an inner wall face surrounded by housing, a rotating vessel containing a plurality of freely movable rigid spheres therein to surface treat the substrate, the cylindrical rotating vessel having a plurality of perforations through which the smooth passage of a surface coating liquid is effected; a substrate support means placed within the cylindrical rotating vessel so as to be rotatable coaxially therewith; a spouting device for spouting the surface coating liquid through the plurality of perforations into the cylindrical rotating vessel, the spouting device is placed crosswise in the circular space circumscribed by the inner wall of the housing and the external wall face of the cylindrical rotating vessel in a horizontal plane to the central axis of the cylindrical rotating vessel; a storing tank for the surface coating liquid; and device for circulating the surface coating liquid to the spouting device.

4 Claims, 6 Drawing Sheets

APPARATUS FOR PRODUCING A SUBSTRATE HAVING A SURFACE WITH A PLURALITY OF SPHERICAL DIMPLES FOR PHOTOCONDUCTIVE MEMBERS

This application is a continuation of application Ser. No. 08/064,350 filed May 20, 1993, now abandoned, which is a continuation of application Ser. No. 07/949,358 filed Sep. 23, 1992, now abandoned, which is a continuation of application Ser. No. 07/826,634 filed Jan. 23, 1992, now abandoned, which is a continuation of application Ser. No. 07/440,676 filed Nov. 24, 1989, now abandoned.

BACKGROUND OF THE INVENTION

1. Field of the Invention

The present invention relates to an improved apparatus for treating the surface of a body to produce a surface treated material which can be suitably used as a constituting member for electric devices, electron devices, or especially as a substrate for the light receiving member for electrophotography.

2. Description of the Prior Art

Metallic plates, metallic cylinders and metallic endless belts for use as substrates for light receiving members, such as electrophotographic photosensitive members, are required to have a surface morphology suitable for use purposes. Accordingly, the surfaces of such metallic substrates are finished by various machining processes or grinding processes. Aluminum alloy substrates are used generally as most suitable substrates. The surface of an aluminum alloy substrate is processed and finished in a desired surface morphology and a desired light receiving layer is formed over the surface thus finished.

However, these conventional surface finishing methods, i.e., machining and grinding, sometimes form intermetallic compounds of Si/Al/Fe system or Fe/Al system, $TiB_2$, or oxides of Al, Mg, Ti, Si and/or Fe in the structure of alloys, form voids of $H_2$ or form surface discontinuity such as grain boundary fracture.

In any case, when an aluminum alloy material is used as the substrate, its surface is made so as to have extremely high cleanliness. However, the surface of such an aluminum alloy material is active even in an ultra-high vacuum of $10^{-9}$ mmHg, and hence an oxide film of a thickness on the order of 30 Angstrom is likely to form on the surface of such an aluminum alloy material even in such an ultra-high vacuum.

Owing to such a problem, a substrate surface-finished by the conventional cutting method or grinding method causes various problems and defects in light receiving members fabricated by using such a substrate. Particularly in the case of an electrophotographic photosensitive member fabricated using such a substrate, the light receiving layer formed on the substrate often becomes unsatisfactory in evenness and homogeneity, and to lack uniformity in electrical, optical and/or photoconductive characteristics entailing defects in images obtained and, sometimes, such an electrophotographic photosensitive member is incapable of practical application. Such problems are particularly conspicuous when the light receiving layer is formed of a non-single-crystal material containing silicon atoms as the matrix.

SUMMARY OF THE INVENTION

Two of the inventor of the present invention proposed previously an apparatus for producing a metallic substrate having a finished surface intended for use as a constituent element of electric devices, electronic devices and, particularly, electrophotographic photosensitive members, and eliminating the foregoing drawbacks attributable to the conventional methods by U.S. Pat. No. 4,773,244.

This apparatus comprises a cylindrical rotating vessel having an outer surface and an inner surface surrounded by a housing, said rotating vessel containing a plurality of freely movable rigid spheres therein to surface treat said substrate, a substrate supporting means being placed within said cylindrical rotating vessel so as to be rotatable coaxially therewith, means for supplying a surface coating liquid being placed at an upper position above the external wall face of said cylindrical rotating vessel, a storing tank for said surface coating liquid being placed at a lower position below the external wallfoil of said cylindrical rotating vessel, and means for circulating said surface coating liquid to said supplying means, said cylindrical rotating vessel having a plurality of perforations through which the smooth passage of said surface coating liquid is permitted.

An electrophotographic photosensitive member fabricated by using a surface-finished substrate produced by this apparatus is more or less satisfactory.

As a result of studies made by the present inventors in order to improve this apparatus, the present inventors have obtained knowledge as below mentioned.

That is, fine particles are caused upon collision of the substrate material with the rigid spheres and they remain on the surface of the substrate material. Because of this, it takes a long period of time to clean the finished surface of the substrate material in order to sufficiently remove those fine particles remaining fine. In addition to this, those fine particles are sometimes incorporated into the texture of the substrate material to make an electrophotographic photosensitive member fabricated by using such a substrate and result in defective images.

The present invention has been accomplished through extensive studies by the present inventors in order to solve those problems in the foregoing apparatus.

It is an object of the present invention to provide an improved substrate producing apparatus eliminating the above problems of the foregoing apparatus.

Another object of the present invention to provide an improved substrate producing apparatus which enables one to form a light receiving layer exhibiting stable electrical optical and photoconductive characteristics and capable of various desired applications to electronic devices.

It is a further object of the present invention to provide an improved substrate producing apparatus which enables one to form a light receiving layer stably exhibiting desirable electrical, optical and photoconductive characteristics and having an excellent resistance against light-induced fatigue, durability upon repeated use and moisture resistance, and which is entirely or almost entirely free of residual potential, and capable of preparing a desirable electrophotographic photosensitive member.

To achieve the object of the invention, the present invention provides an apparatus for producing a substrate having a surface with a plurality of spherical dimples suitable for light receiving members which comprises: a cylindrical rotating vessel having an external wall face and an inner wall face surrounded by a housing, said rotating vessel containing a plurality of freely movable rigid spheres therein to surface treat said substrate, said cylindrical rotating vessel having a plurality of perforations through which the smooth passage of a surface coating liquid is permitted; a substrate supporting means being placed within said cylindrical rotating vessel so as to be rotatable coaxially therewith; a spouting means for spouting said surface coating liquid through said plurality of perforations into said cylindrical rotating vessel, said spouting means being placed crosswise in the circular space circumscribed by the inner wall of said housing and the external wall face of said cylindrical rotating vessel in a horizontal plane to the central axis of said cylindrical rotating vessel; a storing tank for said surface coating liquid; and means for circulating said surface coating liquid to said spouting means.

A feature of the apparatus according to the present invention lies in the mechanism of spouting the surface coating liquid with a pressure to provide the rigid spheres with a kinetic energy corresponding to the potential energy obtained when the rigid sphere is naturally dropped from the height preferably n the range of 0.05 to 2.0 m or more preferably in the range of 0.1 to 0.5 m and with a spraying angle in the range of ±45° with respect to a horizontal plane (0°) to the central axis of the cylindrical rotating vessel, so that the rigid spheres are effectively impinged to the surface of the substrate and said surface is provided with a plurality of spherical dimples caused by the rigid spheres.

The substrate producing apparatus in accordance with the present invention provides the following effects.

(i) The surface of a metallic body, such as an aluminum alloy body, can be finished in a desirable surface morphology without entailing the formation of intermetallic compounds and metal oxides in the alloy texture and the formation of voids and surface discontinuity, such as grain boundary fracture by making rigid spheres collide to the surface of the metallic body at a predetermined velocity.

(ii) No oxide film forms over the surface of the metallic substrate when the surface finishing process is carried out under the presence of a liquid containing a long chain hydrocarbon even if the surface finishing process is carried out under the normal pressure.

(iii) Fine particles caused upon collision the metallic substrate with the rigid spheres do not incorporate into the surface texture of the metallic substrate because the fine particles are removed immediately from the surface of the substrate by the liquid.

(iv) A desirable uniform and homogeneous light receiving layer, such as an a-Si(H,X) film, can be effectively formed on the surface of the substrate thus finished by, for example, a glow-discharge film forming method. A light receiving member having the light receiving layer prevents the formation of fringe patterns for an image obtained and stably provides an image of excellent image quality because light transmitted through the light receiving layer reflects at the layer interface and also at the surface of the substrate and those reflected lights interfere with each other to prevent the formation of fringe patterns for the image.

DESCRIPTION OF THE PREFERRED EMBODIMENTS

Apparatus for producing substrates for light receiving members, embodying the present invention will be described hereinafter with reference to the accompanying drawings, which, however, is not limitative and the present invention may be practiced otherwise than as specifically described herein.

Figure 1A:
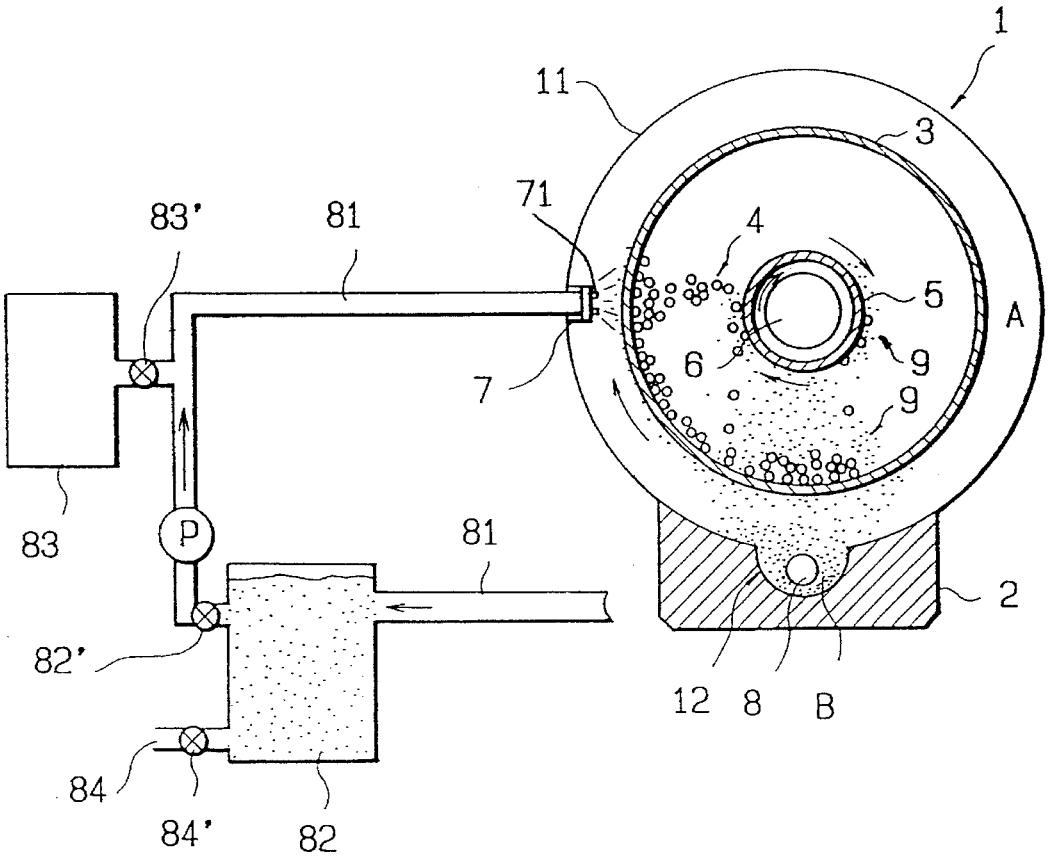
FIG. 1(A) is a schematic sectional view of an apparatus for producing a substrate for a light receiving member, in a first embodiment according to the present invention.

FIG. 1(A) is a schematic sectional view of a typical apparatus for producing a substrate for a light receiving member, embodying the present invention.

In FIG. 1(A), indicated at 1 is a surrounding wall employed in the apparatus. The surrounding wall 1 has a circular portion 11 defining a circular space A, a semicircular portion 12 downwardly protruding from the bottom of the circular portion 11 defining a semicircular space B serving as coating liquid storage means. The surrounding wall 1 is formed in an integral, perfectly hermetic construction by forming a pressure-resistant, heat-resistant, chemical-resistant metallic plate, such as a stainless steel plate.

The surrounding wall 1 has the appearance of an elongate housing. The housing is secured hermetically by opposite side walls, not shown, having a shape formed by the spaces A and B. The apparatus is supported fixedly on a supporting base 2 with the protruding portion 12 fitted in a complementary recess formed in the supporting base 2.

A cylindrical rotating vessel 3 is disposed in the central portion of the space A defining an annual space of a suitable width together with the surrounding wall 1. The rotating vessel 3 is formed of a perforated plate, such as a punching metal, in an integral unit. The rotating vessel 3 is journaled at its opposite ends on the side walls of the housing, not shown. Driving means, not shown, is interlocked with one end of the rotating vessel 3 to rotate the rotating vessel 3. Rigid spheres 4 of perfect sphericity or rigid spheres 4 having rugged surface are contained in the rotating vessel 3. When the rotating vessel 3 is rotated, the rigid spheres 4 are carried by the wall of the rotating vessel 3 near to the horizontal point of the rotating vessel 3 by the action of the perforation and centrifugal force, and then the rigid spheres are driven for flight by a coating liquid as shown in FIG. 1(A). A cylindrical substrate 5 (for example, an aluminum cylinder for fabricating a supporting member) is supported within and coaxially with the rotating vessel 3 on a rotary shaft 6 supported on the side walls of the housing and interlocked with driving means, not shown.

A coating liquid spouting pipe 7 provided with nozzles 71 is fixed to the side part of the surrounding wall 1 by suitable means so as to extend in the central portion of the space A of the side portion of the cylindrical rotating vessel 3.

Indicated at 8 is an opening of a feed pipe 81 for feeding a coating liquid 9. The feed pipe 81 projects through the wall of the housing 1 into the semicircular space B. The feed pipe 81 is connected through pump means to the coating liquid spouting pipe 7. A coating liquid tank 82 is provided with a drain pipe 84 connected to the bottom thereof and valve means 84' provided on the drain pipe 84. Unnecessary matters, such as fine metallic particles, deposited in the bottom of the coating liquid tank 82 are discharged through the drain pipe 84 to maintain a clear coating liquid clear. A clear coating liquid tank 82 is replenished with an amount of the coating liquid corresponding to that of the coating liquid drained through the drain pipe 84 by a supply tank 83. All the coating liquid is changed for new coating liquid after a set number of cycles by closing valve means 82', opening the valve means 84' to drain all the coating liquid in the system through the drain pipe 84, and replenishing the system with the new coating liquid by the supply tank 83.

Figure 2A:
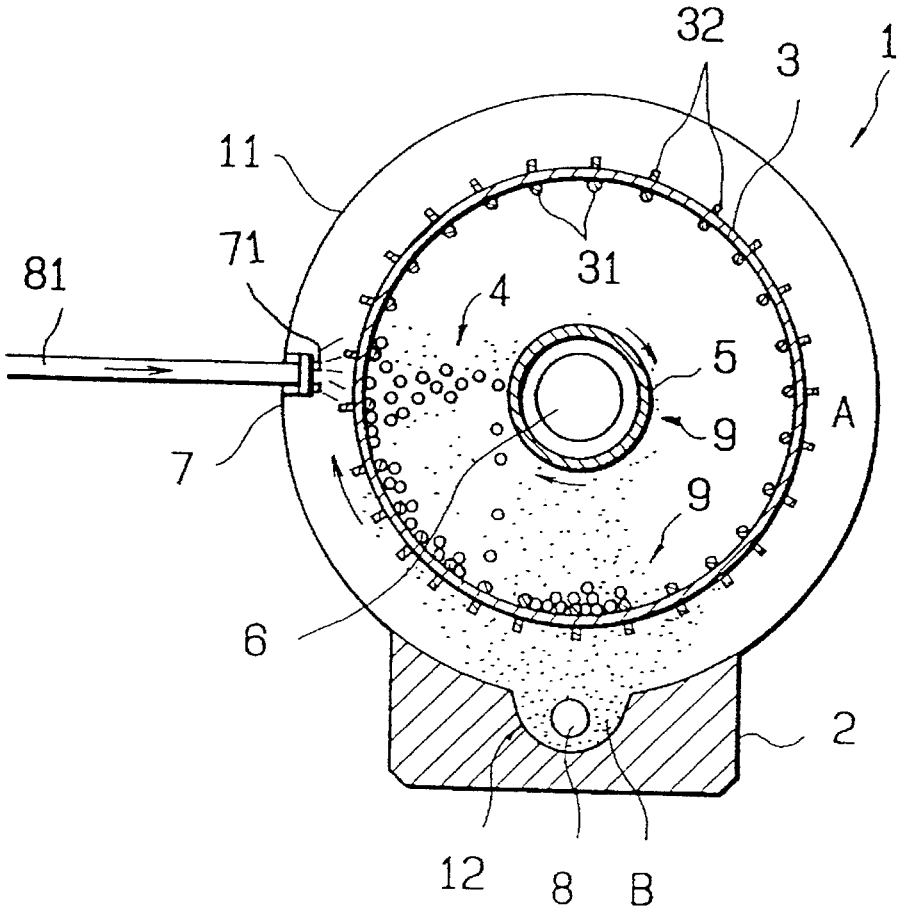
FIG. 2(A) is a fragmentary schematic sectional view of an apparatus for producing a substrate for a light receiving member, in a second embodiment according to the present invention.

FIG. 2(A) is a schematic sectional view of an apparatus for producing a substrate for a light receiving member, in a second embodiment according to the present invention. Referring to FIG. 2(A), a plurality of liquid stopping bars 32 are extended fixedly and longitudinally on the outer circumference of the wall of a rotating vessel 3, and a plurality of rigid sphere holding rods 31 are extended fixedly and longitudinally on the inner circumference of the rotating vessel 3.

The manner of operation of the apparatus shown in FIG. 2(A) is the same as that of the apparatus shown in FIG. 1(A). The liquid stopping bars 32 ensure the smooth flow of the coating liquid 9 into the rotating vessel 3, and the rigid sphere holding rods 31 ensure the smooth lift of the rigid spheres 4.

Figure 3A:
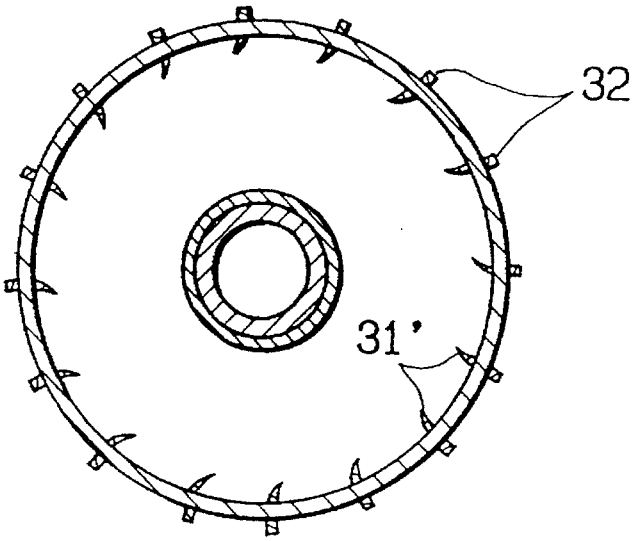
FIG. 3(A) is a schematic sectional view of another rotating vessel for an apparatus for producing a substrate for a light receiving member, embodying the present invention.

An apparatus embodying the present invention shown in FIG. 3(A) is a modification of the apparatus shown in FIG. 2(A). As shown in FIG. 3(A) a rotating vessel 3 is provided with elongate rigid sphere holding blades 31' instead of the rigid sphere holding rods 31. The rigid sphere holding blades 31' ensure the further effective lift of the rigid spheres 4 and, at the same time, ensure the further accurate blowing of the rigid spheres 4 in a coating liquid spouting range.

The operation of the apparatus for producing a substrate for a light receiving member, embodying the present invention shown in FIG. 1 will be described hereinafter. The cylindrical substrate 5 is disposed in the rotating vessel 3 containing a necessary number of the rigid spheres 4, and the coating liquid 9, such as a mixed liquid of 1 part polybutene and 1 part trichloroethane, supplied from the supply tank 83 is spouted through the nozzles 71 of the coating liquid spouting pipe 7 against the surface of the rotating vessel 3. Then the coating liquid 9 flows into the rotating vessel 3 to form a liquid film over the surface of the cylindrical substrate 5 provided within the rotating vessel 3. The remaining portion the coating liquid 9 flows downward, wets the rigid spheres 4, and then flows through the perforations of the rotating vessel 3 into the space B. The coating liquid 9 stored in the space B is pumped into the coating liquid storage tank 82 through the feed pipe 81, and then the coating liquid 9 is circulated through the coating liquid spouting pipe 7. After a set amount of the coating liquid 9 has been supplied into the system, the valve mean 83' is closed to stop supplying the coating liquid 9 from the supply tank 83. Subsequently, the rotation of the rotating vessel 3 and the cylindrical substrate 5 is started.

The rotating vessel 3 and the cylindrical substrate 5 may be rotated in either direction relative to each other, however, it is preferable to rotate the rotating vessel 3 and the cylindrical substrate 5 in opposite directions respectively.

Preferably, the rotating vessel 3 is rotated at a rotating speed which arranges the rigid spheres 4 in one or two layers over the inner surface of the rotating vessel 3 in an area corresponding to the spouting position. If the rotating speed is excessively low, an insufficient centrifugal force acts on the rigid spheres 4, hence the rigid spheres 4 are not arranged uniformly and the rigid spheres 4 are not lifted along the inner surface of the rotating vessel 3 to an appropriate position and, consequently, the rigid spheres 4 cannot be blown uniformly against the surface of the cylindrical substrate 5. If the rotating speed is excessively high, the rigid spheres 4 are arranged uniformly over the inner surface of the rotating vessel 3 and are lifted up to sufficiently high position; however, the spouting pressure must be increased accordingly so that the coating liquid is able to blow the rigid spheres 4 against the excessively increased centrifugal force, the substantial ratio of perforation is decreased to reduce the efficiency of the process.

On the other hand, the rotating speed of the cylindrical substrate 5 is regulated so that the rigid spheres 4 impinge uniformly on the surface of the cylindrical substrate 5 to form dimples uniformly over the entire surface of the cylindrical substrate 5.

Thus, dimples are formed at the surface of the cylindrical substrate 5 while the surface of the cylindrical substrate is coated with a thin film of the coating liquid.

The foregoing operation may be conducted under the normal pressure at the normal temperature. However, it is preferable to increase the coating liquid spouting pressure or to conduct the operation in a vacuum, when it is desired to enhance the impact of the rigid spheres on the surface of the cylindrical substrate.

After the surface of the cylindrical substrate has thus been processed of a predetermined time, the rotating vessel 3 and the cylindrical substrate 5 are stopped and the circulation of the coating liquid is stopped. The cylindrical substrate thus processed has a surface having spherical dimples uniformly distributed over the entire area of the surface and uniformly coated with a thin hard film. Since the surface of the cylindrical substrate is isolated perfectly from the atmosphere by the hard film, it is totally impossible that any oxide film is formed over the surface of the cylindrical substrate, even if the substrate is formed of an aluminum alloy, when the cylindrical substrate is stored outside the system for the subsequent processing.

After removing the processed cylindrical substrate from the apparatus of the present invention, the next cylindrical substrate is mounted on the apparatus, and then the foregoing surface-finishing cycle is repeated. Thus the cylindrical substrates surface-finished in a desired quality can successively be produced.

The apparatus of the present invention is designed for processing cylindrical substrates of any size. For example, the cylindrical rotating vessel 3 is 300 mm in diameter and 450 mm in length, the horizontal distance between the spouting nozzles 71 and the cylindrical rotating vessel 3 is in the range of 50 mm to 100 mm, the coating liquid spouting pipe 7 is about 15 mm in diameter, the nozzles 71 are arranged at intervals in the range of about 5 mm to 50 mm so that the spraying angle is not excessively large and the streams of the coating liquid spouted by the nozzles 71 may not interfere with each other, and the rotary shaft 6 can be replaced with other rotary shaft of a size corresponding to the size (diameter and length) of the cylindrical substrate to be processed.

As stated above, the cylindrical rotating vessel 3 is formed integrally of a perforated plate, such as a punching metal. Preferably, the size of the perforations is smaller than that of the rigid spheres to restrain the rigid spheres from falling off the rotating vessel 3; for example, the preferable size of the perforations is in the range of about 0.3 mm to about 1.9 mm when the size of the rigid spheres is in the range of 0.4 to 2.0 mm. Although the higher the ratio of perforation (the ratio of the total area of the perforations to that of the circumference of the rotating vessel), the higher is the efficiency of the operation the ratio of perforation is in the range of 71% to 78% at the maximum depending on the material of the rotating vessel and, preferably, on the order of 50%, in view of the required strength of the rotating vessel (the rotating vessel contains about 1.5 kg of stainless steel balls) and working facility.

The height of the liquid stopping bars 32 is in the range of 3 mm to 5 mm and that of the rigid sphere holding rods 31 is in the range of 3 mm to 6 mm. The liquid stopping bars 32 and the rigid sphere holding rods 31 are arranged at equal circumferential intervals in the range of 10 mm to 150 mm.

Although the present invention has been described as applied to an apparatus for processing a single cylindrical substrate at a time, naturally, an apparatus according to the present invention may be constructed to process a plurality of cylindrical substrate simultaneously.

The substrate surface-finished by the foregoing operation is supplied to a film forming apparatus (light receiving film forming apparatus), not shown, after removing the hard film through a solvent washing process and drying the surface in an absolutely clean condition. The apparatus of the present invention is capable of carrying out the solvent washing process.

When the apparatus is applied to the solvent washing process, the coating liquid is drained from the system and the system is cleaned after completing the surface finishing operation. Subsequently, a washing liquid, such as trichloroethane, is fed from a washing liquid tank, not shown, through the feed pipe 81 to the spouting pipe 7 to spout the washing liquid horizontally through the nozzles 71. During this washing operation, the rotating vessel 3 is held stationary an the cylindrical substrate 5 is rotated. The washing liquid contained in the space B is recirculated or is discharged from the system through the drain pipe 84 by closing the valve means 82' and opening the valve means 84'.

The substrate thus surface-finished by the apparatus of the present invention has a surface having desired spherical dimples over the entire area thereof, and perfectly isolated from the atmosphere by the hard film coating the entire are thereof. The hard film can very efficiently be removed by washing using the solvent, such as trichloroethane, an the surface can be very efficiently and uniformly dried to provide an optimum substrate for a light receiving member.

Substrates to be surface-finished by the apparatus of the present invention may be formed of either a conductive material or an electrically insulating material.

Possible conductive substrates are those formed of NiCr, a stainless steel, Al, Cr, Mo, Au, Nb, Ta, V, Ti, Pt, Pb or an alloy of those metals.

Possible electrically insulating substrates are films or sheets formed of a synthetic resin, such as a polyester, a polyethylene a polycarbonate, cellulose, acetate, a polypropylene, a polyvinyl chloride, a polyvinylidene chloride, a polystyrene or a polyamide, paper sheets, and plates of glass or a ceramic. Preferably, at least one of the surfaces of each of those electrically insulating substrates is processed to make the surface conductive, and a light receiving layer is formed on the conductive surface.

To make the surface of a glass substrate conductive, for instance, a thin metallic film of NiCr, Al, Cr, Mo, Au, Ir, Nb, Ta, V, Ti, Pt, Pd, $In_2O_3$, $SnO_2$ or ITO($In_2O_3$ + $SnO_2$) is formed on the surface. For a synthetic resin film substrate, such as a polyester film substrate, a thin metallic film of NiCr, Al, Ag, Pb, Zn, Ni, Au, Cr, Mo, Ir, Nb, Ta, V, Tl or Pt is formed on its surface by vacuum evaporation, electron beam evaporation or sputtering or is bonded to its surface to make the surface conductive. The substrate may be of any optional shape, such as cylindrical or flat, depending on the purpose. A substrate for an electrophotographic light receiving member, for instance, may be formed in a cylindrical shape for continuous high-speed copying operation. The thickness of the substrate is determined properly so that a desired light receiving member can be formed. A substrate intended for forming a flexible light receiving member may be formed in the least possible thickness which is large enough to meet the requisite functions of the substrate. However, in view of handling facility in processing the substrate and mechanical strength, the thickness of the substrate, in general, is not less than 10 μm.

The rigid spheres, normally, 0.4 mm to 2.0 mm in diameter, used in the apparatus of the present invention for finishing the surface of a substrate, namely, for forming desired dimples at the surface of a substrate, are those formed of a stainless steel, aluminum, a steel, nickel, a brass, a ceramic or a plastic. Among those possible rigid spheres, stainless steel spheres and steel spheres are preferable from the viewpoint of general requisite conditions including durability and cost. Although the hardness of the rigid spheres may be either higher or lower than that of the substrate, it is desirable that the hardness of the rigid spheres is higher than that of the substrate when the rigid spheres are used repeatedly for finishing the surfaces of a plurality of substrates.

The coating liquid used for coating the surface of a substrate in forming desired dimples at the surface of the substrate by using the rigid spheres must be capable of forming a coat having the least necessary thickness for uniformly coating the surface, and capable of quickly solidifying in a hard film capable of being removed uniformly and completely by washing without leaving any slobbery stain to enable the surface to be dried in an absolutely clean condition. Accordingly, the coating liquid must meet the following requirements: (a) the coating liquid must have low viscosity; (b) the coating liquid must have static electricity eliminating capability; (c) the coating liquid must have coating capability; (d) the coating liquid must form a hard film capable of being easily removed by washing; and (e) the coating liquid must form a hard film capable of being removed by washing without leaving any slobbery stain to enable the surface to be dried in an absolutely clean condition.

To meet these requirements, generally, a coating liquid prepared by dissolving a long chain molecular hydrocarbon in an appropriate organic solvent is used.

As such long chain molecular hydrocarbon there can be mentioned polybutenes expressed by the formula:

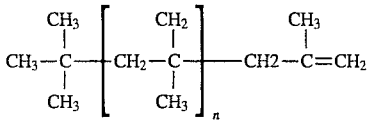

where n is an integer of 3 to 40. Among these polybutenes, polybutenes expressed by the above formula in which n is in the range of 3 to 20 are particularly preferable.

Some of the polybutenes expressed by the above formula by themselves meet the foregoing requirements (a) to (e). Such a polybutene by itself can be a coating liquid.

As the organic solvent to be used for dissolving a long chain molecular hydrocarbon such as the foregoing polybutenes to prepare a coating liquid meeting the foregoing requirements (a) to (e), there can be mentioned, for example, ether, heptane, toluene, trichloroethylene, trichloroethane, etc.

Among these organic solvents trichloroethane is most preferable. That is, when trichloroethane is used, the foregoing polybutene can be easily and effectively dissolved therein to obtain a desirable coating liquid which is malleable and coat the entire body surface uniformly with an even and extremely thin liquid coat which does not give any hindrance of the formation of an uneven shape composed of a plurality of fine spherical dimples at the body surface by the falling rigid spheres thereonto and brings about faster solidification of the liquid coat after the uneven shape formation toward the body surface. And using said coating liquid in washing process results in washing out the solidified coat effectively and completely to lead to obtaining desirable surface-treated material having an absolute clean uneven shaped surface provided with irregularities composed of a plurality of fine spherical dimples without any unevenness and any residue due to the coat in the successive drying process.

And, as for the coating liquid composed of said polybutene and trichloroethane, the constituting ratio of the two substances is an important factor. The constituting ratio of said polybutene versus trichloroethane is preferably in the range of 1:4 to 4:1 and most preferably 1:1.

Figure 4A:
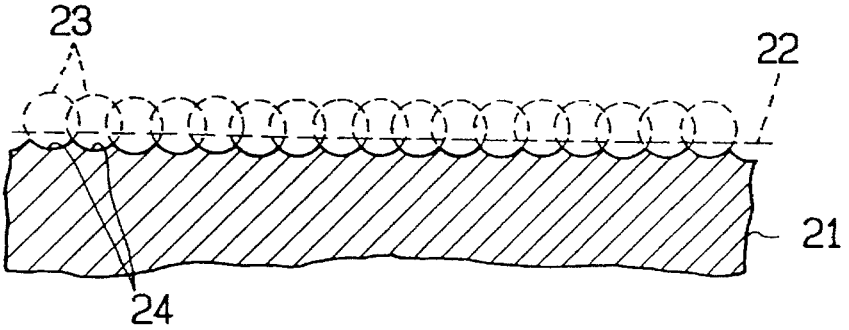
FIGS. 4(A) to 4(C) are typical views of assistance in explaining the morphology of the surface of a substrate formed by an apparatus embodying the present invention.
Figure 4B:
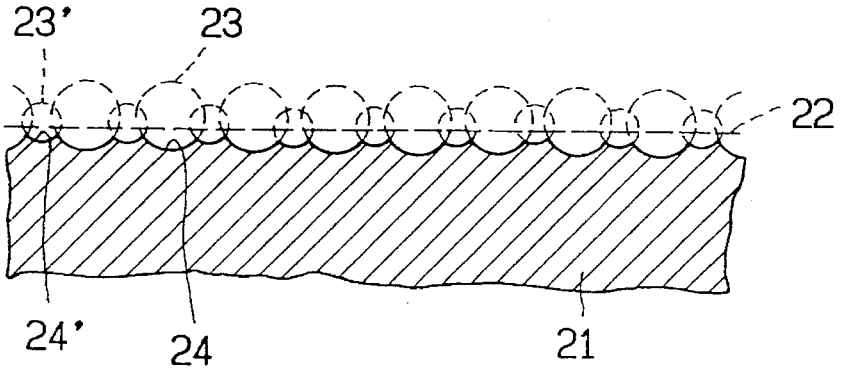
Figure 4C:
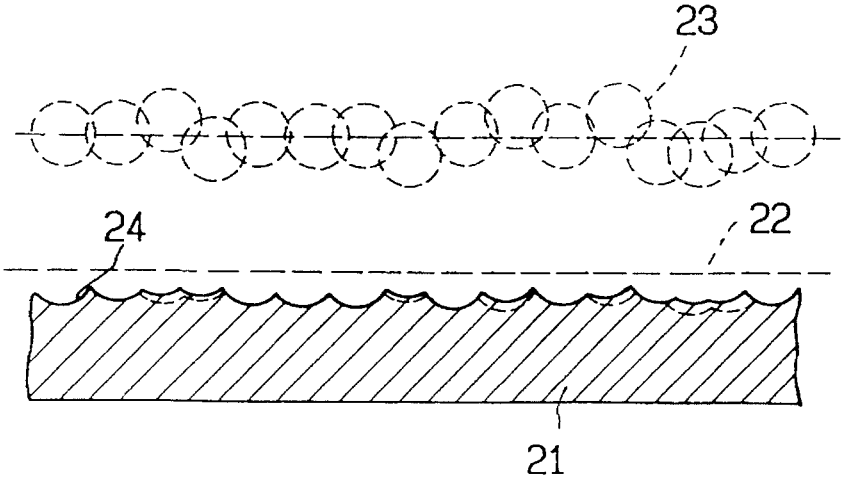

Incidentally, the surface of a substrates surface-finished by the apparatus of the present invention by using a plurality of rigid spheres has morphologies as shown in FIGS. 4(A) to 4(C). The surface 22 of a substrate 21 shown in FIG. 4(A) is finished by blowing a plurality of rigid spheres 23 of substantially the same diameters against different portions of the surface 22 with substantially the same kinetic energy levels by the jets of the foregoing coating liquid. The surface thus finished has a regularly rugged morphology formed of a plurality of overlapping dimples 24 of substantially the same curvatures (R) and substantially the same widths. Naturally, the rigid spheres 23 must be blown so that the rigid spheres 23 impinge on the surface 22 of the substrate 21 at different moments to form such overlapping dimples 24.

The surface 22 of a substrate 21 as shown in FIG. 4(B) is finished by blowing a plurality of rigid spheres 23 of substantially the same diameters and substantially the same kinetic energy levels and a plurality of rigid spheres 23' of substantially the same diameters different from those of the rigid spheres 23 and of substantially the same kinetic energy levels substantially the same as or different from those of the rigid spheres 23 by the jets of the foregoing coating liquid. The surface thus finished has an irregularly rugged morphology formed of two kinds of overlapping dimples 23 an 24' differing from each other in curvature and width.

The surface 22 of a substrate 21 as shown in FIG. 4(C) (a plan view (upper illustration) and a sectional view (lower illustration)) is finished by blowing a plurality of rigid spheres 23 of substantially the same diameters and substantially the same kinetic energy levels by the jets of the foregoing coating liquid so that the rigid spheres 23 impinge individually or in an overlapping relation on the surface 22. The surface thus finished has an irregularly rugged morphology formed of overlapping dimples 24 of substantially the same diameters and substantially the same widths.

The substrates respectively having surface morphologies formed of spherical dimples as shown in FIGS. 4(A) to 4(C) are produced by the apparatus of the present invention. In the description given with reference to FIGS. 4(A) to 4(C), the description of the coating liquid is omitted for simplicity.

The effects of the present invention will be understood clearly from the results of the following experiments.

EXPERIMENT 1

Figure 1B:
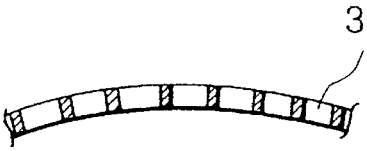
FIG. 1(B) is an enlarged, fragmentary sectional view of the wall of a rotating vessel included in the apparatus of FIG. 1(A).

The apparatus shown in FIG. 1 was used. The cylindrical rotating vessel was 300 mm in diameter and 450 mm in length, was provided with perforations of 0.5 mm in diameter distributed in a ratio of perforation of 50%, and contained 2.5 kg of stainless steel spheres of 0.5 mm in diameter. A cylindrical substrate of 5 mm in thickness, 80 mm in diameter and 360 mm in length formed of an aluminum alloy and mounted on the rotary shaft 6 was processed for twenty-five minutes by spouting a coating liquid prepared by mixing 1 part by weight of polybutene and 1 part by weight of trichloroethane at a spouting pressure of 0.6 kg/cm$^2$ while the rotating vessel was rotated at 30 rpm.

And a plurality of the foregoing cylindrical substrates were separately processed in this way by adjusting the open angles of the nozzles 71 to 0°, 45°, −45° and 60° respectively with respect to a horizontal plane (0°) to the central axis of the cylindrical rotating vessel 3.

In each case, after the completion of the surface-finishing process, the cylindrical substrate thus surface-finished was washed in warm bath with the use of ultrasonic waves, cold bath, then steam bath, wherein trichloroethane was used, to thereby obtain a surface-finished cylindrical substrate.

Figure 5:
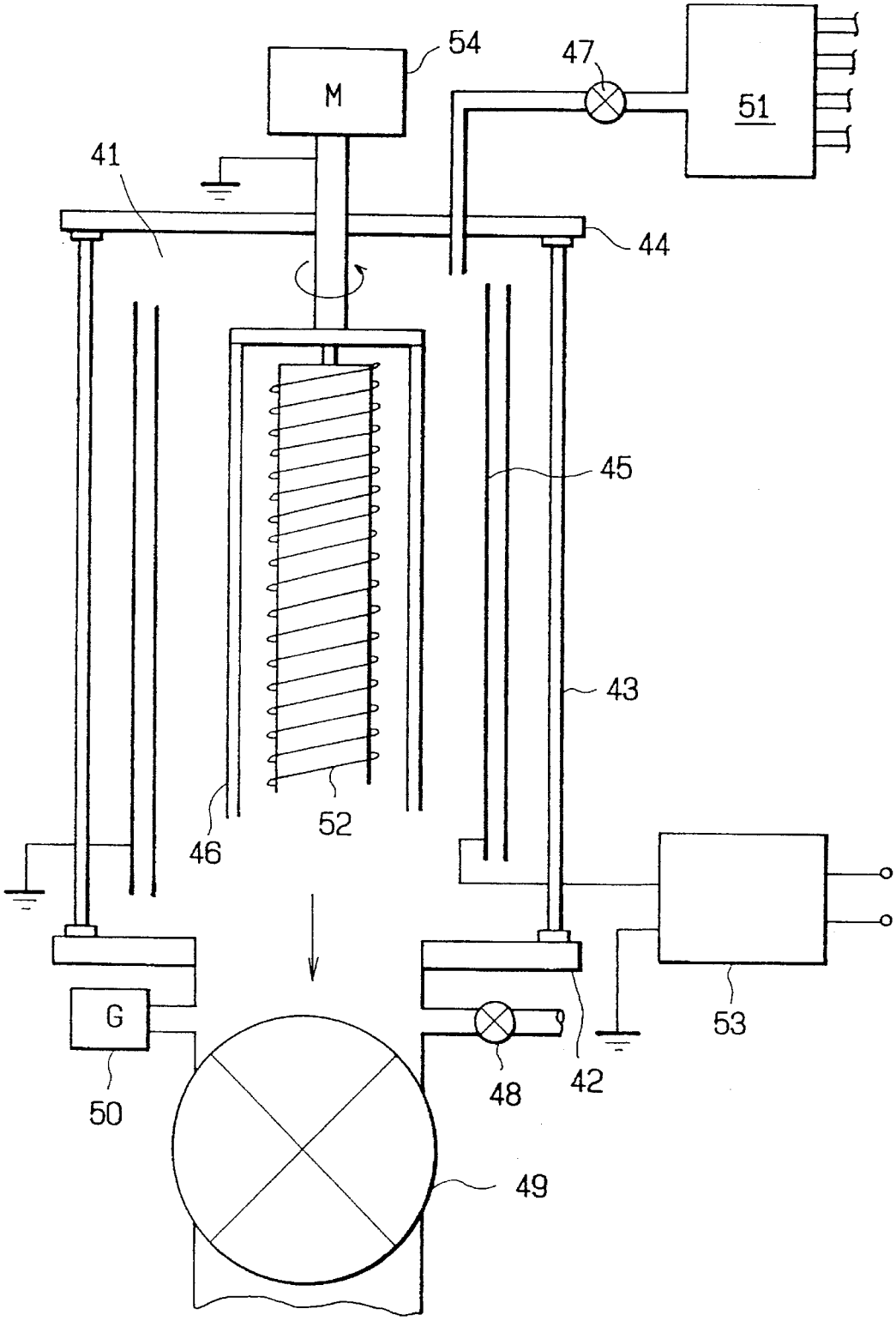
FIG. 5 is a diagrammatic illustration of an apparatus for forming a light receiving member by a glow-discharge decomposition film forming method.
Figure 6:
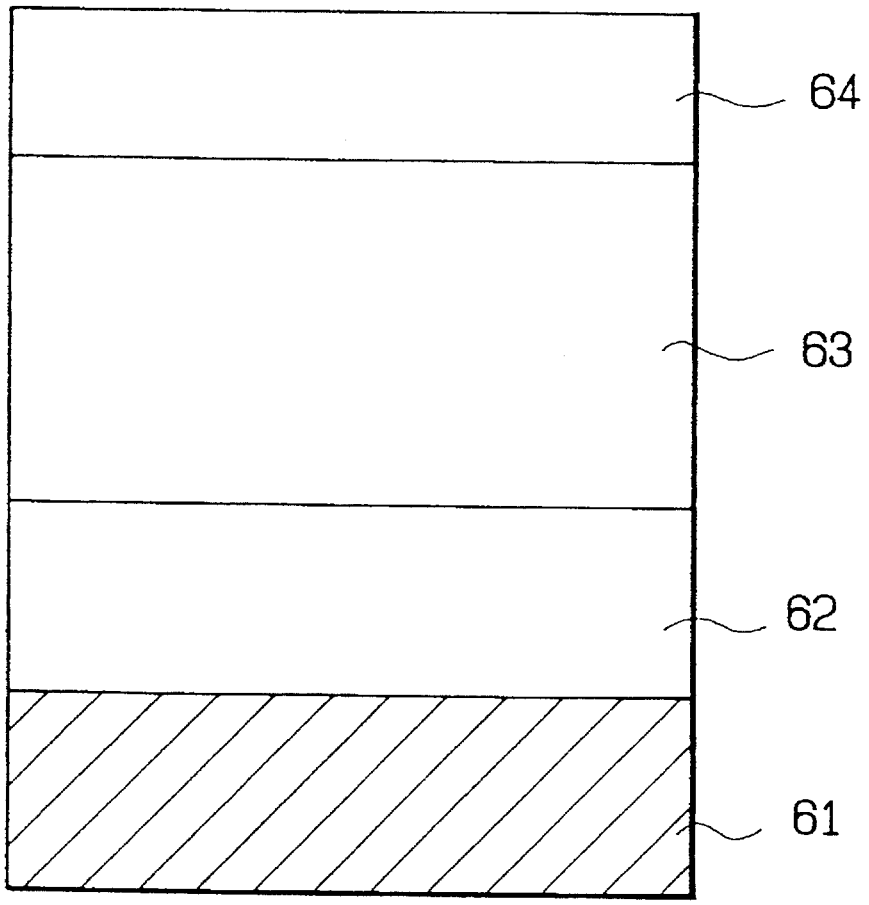
FIG. 6 is a schematic cross sectional view of a light receiving member typifying those formed by the embodiments of the present invention and controls.

Using each of the resultant surface-finished cylindrical substrates, there are prepared a plurality of electrophotographic photosensitive drum samples each having a light receiving layer comprising a charge injection inhibition layer 62, a photoconductive layer 63 and a surface protective layer 64 being laminated in this order on the cylindrical substrate 61 as shown in FIG. 6 by means of a glow discharge decomposition method using the glow discharge film-forming apparatus shown in FIG. 5 under the conditions shown in Table 1.

Each of the resultant photosensitive drum samples was set to a conventional Canon NP 9030 electrophotographic copying machine having digital exposure functions and using semiconductor laser of 780 nm in wavelength and 80 μm in spot size (product of CANON KABUSHIKI KAISHA), which was modified for experimental purposes, to evaluate its image-forming properties. As a result, there were obtained results as shown in Table 2.

From the results shown in Table 2, it has been found that the cylindrical substrate surface-finished by setting the nozzles in a substantially horizontal position is most suitable as a substrate for a light receiving member such as an electrophotographic photoconductive drum, and the light receiving member fabricated by using the same cylindrical substrate provides excellent electrophotographic properties.

It has also been found that an appropriate spraying angle of the coating liquid through the nozzles is desired to be in the range of 10° to 30°. It has been further found that the liquid pressure (kgf/cm$^2$) acting on the surface of the rotating vessel increases excessively to damage the surface of the rotating vessel when the spraying angle is less than 10° because the cross section of the spouting liquid from the nozzles is to be made small; and the spouting pressure should be comparatively high when the spraying angle is greater than 30° because the coating liquid is spread over the surface of the rotating vessel in an excessively large area.

Now, the glow-discharge film-forming apparatus shown in FIG. 5 for preparing a light receiving member will be described hereinafter.

A deposition chamber 41 is defined by a base plate 42, side walls 43 and a top plate 44. A cathode 45 is disposed within the deposition chamber 41. A cylindrical substrate 46 formed of, for example, an aluminum alloy, prepared by the apparatus of the present invention is positioned in the central portion of the cathode 45. The substrate 46 serves also as an anode. An A-Si film is to be deposited over the surface of the substrate 46.

In operation, first, a source gas inlet valve 47 and a leak valve 48 are closed and a discharge valve 49 is opened to evacuate the deposition chamber 41. Upon the coincidence of the indicator of a vacuum gage 40 with an indication of $5\times10^{-6}$ torr, the source gas inlet valve 47 is opened to feed a mixed source gas prepared in a predetermined mixing ratio by a mass-flow controller, such as a mixed gas of $SiH_4$ gas, $Si_2H_6$ gas and $SiF_4$ gas, into the deposition chamber 41. While the mixed source gas is being supplied the opening of the discharge valve 49 is regulated with reference to indication on the vacuum gage 40 so that the internal pressure of the chamber 41 is adjusted to a desired value. After confirming the coincidence of the surface temperature of the cylindrical substrate 46 heated by a heater 52 with a predetermined temperature, a high-frequency power source 53 supplies desired power to start glow discharge in the deposition chamber 41.

The cylindrical substrate 46 is rotated at a constant rotating speed by a motor 54 during the film forming process to form a film uniformly over the surface of the cylindrical substrate 46. Thus, an a-Si film is deposited on the surface of the cylindrical substrate 46.

A light receiving member shown in FIG. 6 comprises a substrate 61, a charge injection inhibition layer 62, a photoconductive layer 33, and a surface protective layer 64.

The charge injection inhibition layer 62 is formed of, for example, a-Si containing hydrogen atoms and/or halogen atoms and atoms of an element in group III or V, which is used as a substance of dominating the conductivity. Preferably, the thickness of the charge injection inhibition layer is in the range of 0.01 to 10 μm, more preferably, in the range of 0.05 to 8 μm, most preferably, in the range of 0.07 to 5 μm.

The charge injection inhibition layer may be substituted by a blocking layer formed of an electrical insulating material, such as $Al_2O_3$, $SiO_2$, $Si_3N_4$ or polycarbonate or may be provided additionally with a blocking layer.

The photoconductive layer 63 is formed of a-Si containing hydrogen atoms and halogen atoms and when desired, a substance for dominating the conductivity other than that contained in the charge injection inhibition layer. Preferably, the thickness of the photoconductive layer is in the range of 1 to 100 μm, more preferably, in the range of 1 to 80 μm, most preferably, in the range of 2 to 50 μm.

The surface protective layer 64 is formed of, for example $SiC_x$ or $SiN_x$. Preferably, the thickness of the surface protective layer is in the range of 0.01 to 10 μm, more preferably, in the e range of 0.02 to 5 μm, most preferably, in the range of 0.04 to 5 μm.

EXPERIMENT 2

The procedures of Experiment 1 were repeated, except that the coating liquid spouting pressure was varied for 0.1 kgf/cm$^2$, 0.4 kgf/cm$^2$ and 1.0 kgf/cm$^2$ while adjusting the open angles of the nozzles to 0° with respect to a horizontal plane (0°) to the central axis of the cylindrical rotating vessel 3, to thereby obtain a plurality of electrophotographic photosensitive drums samples.

Each of the resultant electrophotographic photo-sensitive drum samples was evaluated in the same manner as in Experiment 1.

As a result, there were obtained results as shown in Table 3.

EXPERIMENTS 3 and 4

Experiment 3

Figure 2B:
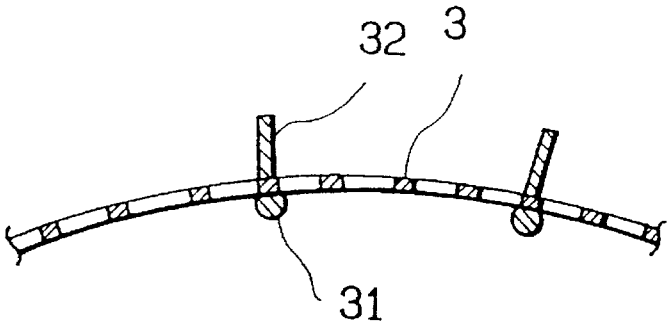
FIG. 2(B) is an enlarged fragmentary sectional view of the wall of a rotating vessel included in the apparatus of FIG. 2(A).

The apparatus of the present invention incorporating the rotating vessel shown in FIGS. 2(A) and 2(B) provided with the liquid stopping bars 32 and the rigid sphere holding rods 31 was used.

Using this apparatus, the procedures of Experiment 1 were repeated, except that the open angles of the nozzles 71 were adjusted to 0° with respect to a horizontal plane (0°) to the central axis of the cylindrical rotating vessel 3, to thereby obtain a plurality of electrophotographic photosensitive drum samples. As a result of evaluating each of the resultant samples in the same manner as in Experiment 1, there were obtained the results shown in Table 4.

EXPERIMENT 4

Figure 3B:
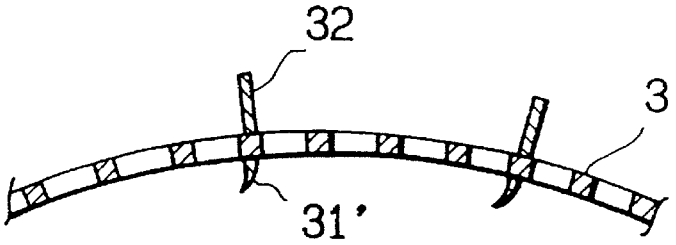
FIG. 3(B) is an enlarged fragmentary sectional view of the wall of the rotating vessel of FIG. 3(A).

The apparatus incorporating the rotating vessel shown in FIGS. 3(A) and 3(B) provided with the liquid stopping bars 32 and the rigid sphere holding blades 31' was used.

Using this apparatus, the procedures of Experiment 1 were repeated, except that the open angles of the nozzles 71 were adjusted to 0° with respect to a horizontal plane (0°) to the central axis of the cylindrical rotating vessel 3, to thereby obtain a plurality of electrophotographic photosensitive drum samples. As a result of evaluating each of the resultant samples in the same manner as in Experiment 1, there were obtained the results shown in Table 4.

From the results shown in Table 4, it has been found that the cylindrical substrates surface-finished by the apparatus respectively incorporating the rotating vessels shown in FIGS. 2(A) and 3(A) enable to provide desirable light receiving members having excellent characteristics.

As is apparent from the foregoing description, the apparatus of the present invention, which spouts the coating liquid horizontally at a predetermined spouting pressure instead of pouring down in a shower at low pressure, provides that following effects.

(a) In processing the surface of a cylindrical substrate, fine particles caused upon impinging the rigid spheres to the surface of the substrate are restrained from incorporating into the surface texture of the substrate and desirable dimples of fixed size distributed in an narrow area are effectively formed at the surface of the substrate.

(b) Kinetic energy is given to the rigid spheres sticking to the inner surface of the rotating vessel so as to make the rigid spheres to be effectively impinged to the surface of the substrate, which expands the possible ranges of the working conditions and the conditions may be easily set up.

(c) In order to obtain a desirable state of dimples formed at the surface of the substrate on the basis of the gravity of the rigid sphere to drop onto the surface of the substrate in the foregoing previously proposed apparatus, it is necessary for the rotating vessel to be of a large size having a diameter of 500 to 1000 mm. However, in the apparatus according to the present invention the rotating vessel can be of the least possible size because the rigid spheres are added wit kinetic energy.

(d) The coating liquid supply system is pressurized and because of this, the rotating vessel and the associated components of the apparatus can be effectively cleaned by supplying a cleaning liquid such as trichloroethane through said supply system.

TABLE 1

| | | Charge injection inhibition layer | Photoconductive layer | Surface protective layer |
|---|---|---|---|---|
| gas used and its flow rate | $SiH_4$ gas | 350 sccm | 350 sccm | 30 sccm |
| | $B_2H_6$ gas | 200 ppm (against $SiH_4$) | — | — |
| | $C_2H_4$ gas | — | — | 300 sccm |
| Substrate temperature (°C.) | | | 250 ± 5 | |
| Inner pressure (Torr) | | | 0.5 | |
| RF (MHz) | | | 13.56 | |
| RF power (W) | | 280 | 300 | 150 |
| Layer thickness (μm) | | 0.6 | 20.0 | 0.1 |

TABLE 2

| angle | defective images* | uneven image | fringe pattern | total evaluation |
|---|---|---|---|---|
| 0° | 0~0.2 | none | none | ⊙ |
| 60° | 0~0.3 | none | none | Δ |
| ±45° | 0~0.1 | none | none | ○ |

Note:
*: mean value of black dots per 100 $cm^2$
⊙: excellent
○: good
Δ: seems acceptable
x: not acceptable

TABLE 3

| spouting pressure of the coating liquid | defective images* | uneven image | fringe pattern | total evaluation |
|---|---|---|---|---|
| 0.1 $kgf/cm^2$ | 1 | some present | some present | Δ |
| 0.4 $kgf/cm^2$ | 0~0.2 | none | none | ⊙ |
| 0.9 $kgf/cm^2$ | 0~0.2 | none | none | ⊙ |

Note:
*: mean value of black dots per 100 $cm^2$
⊙: excellent
○: good
Δ: seems acceptable
x: not acceptable

TABLE 4

| | defective images* | uneven image | fringe pattern | total evaluation |
|---|---|---|---|---|
| Experiment 3 | 0~0.1 | none | none | ⊙ |
| Experiment 4 | 0~0.1 | none | none | ⊙ |

Note:
*: mean value of black dots per 100 $cm^2$
⊙: excellent
○: good
Δ: seems acceptable
x: not acceptable

What is claimed is:

1. An apparatus for producing a substrate having a surface with a plurality of spherical dimples, said substrate being suitable for a light receiving member, said apparatus comprising:

a substrate supporting means for supporting a cylindrical substrate in a rotatable state;

a cylindrical rotating vessel having a circumferential wall with external and inner wall faces said cylindrical rotating vessel containing said substrate supporting means coaxially placed therein such that said cylindrical rotating vessel encloses said substrate supporting means while establishing a desired space between said cylindrical substrate supported on said substrate supporting means and said inner wall face of said cylindrical rotating vessel, said cylindrical rotating vessel containing a plurality of freely movable rigid spheres formed of a material selected from the group consisting of steel, aluminum, nickel, brass, ceramic and plastic, said cylindrical rotating vessel being rotatable so as to allow said rigid spheres to move in the rotation direction of said cylindrical rotating vessel as said cylindrical rotating vessel rotates, said circumferential wall of said cylindrical rotating vessel being provided with a plurality of perforations capable of retaining said rigid spheres on the inner wall face of the cylindrical rotating vessel, said plurality of perforations being of a size which is smaller than that of the rigid spheres and which allows a surface coating liquid to pass therethrough under pressure so as to propel the rigid spheres retained on the inner wall face into collisions with the surface of the cylindrical substrate supported on said substrate supporting means;

a cylindrical external wall member coaxially surrounding the cylindrical rotating vessel, said external wall member having a space or storing the surface coating liquid at a lower portion thereof;

a supplying means for supplying the surface coating liquid under pressure toward the cylindrical rotating vessel such that the surface coating liquid is ejected through said plurality of perforations into the cylindrical rotating vessel, said supplying means terminating in a plurality of nozzles arranged at intervals from about 5 mm to about 50 mm, said supplying means having a means for generating an injection force to said surface coating liquid which provides a kinetic energy to the rigid spheres corresponding to the potential energy obtained when the rigid spheres are dropped from a height of from 0.05 to 2.0 meters; and said plurality of nozzles oriented at an angle of ±45° with respect to a horizontal plane to the central axis of the cylindrical rotating vessel to supply the surface coating liquid toward said cylindrical rotating vessel at said angle of ±45° with respect to the horizontal plane to the central axis of the cylindrical rotating vessel;

a storing tank for storing the surface coating liquid; and circulating means for circulating the surface coating liquid to the supplying means.

2. The apparatus according to claim 1, wherein the surface coating liquid is a liquid containing polybutene.

3. The apparatus according to claim 2, wherein the polybutene is one or more members selected from the group consisting of ether, heptane, toluene, trichloroethylene and trichloroethane.

4. The apparatus according to claim 1, wherein the rigid spheres are of 0.4 mm to 2.0 mm in diameter.

* * * * *

UNITED STATES PATENT AND TRADEMARK OFFICE

CERTIFICATE OF CORRECTION

PATENT NO. : 5,575,849

DATED : November 19, 1996

INVENTOR(S) : MITSURU HONDA ET AL.

It is certified that error appears in the above-identified patent and that said Letters Patent is hereby corrected as shown below:

Title page,
AT [57] ABSTRACT

Line 5, "housing," should read --a housing,--.
Line 6, "surface treat" should read --surface-treat--.
Line 9, "means" should be deleted.
Line 18, "device" should read --a device--.

COLUMN 1

Line 17, "surface treated" should read --surface-treated--.
Line 65, "inventor" should read --inventors--.

COLUMN 2

Line 8, surface treat" should read --surface-treat--.
Line 24, "below mentioned." should read --mentioned below.--.
Line 30, "those" should read --those remaining--.
Line 31, "particles remaining fine." should read --particles.--.
Line 42, "invention" should read --invention is--.
Line 64, "surface treat" should read --surface-treat--.

COLUMN 3

Line 16, "n" should read --in--.
Line 38, "collision" should read --collision of--.

UNITED STATES PATENT AND TRADEMARK OFFICE

CERTIFICATE OF CORRECTION

PATENT NO. : 5,575,849

DATED : November 19, 1996

INVENTOR(S) : MITSURU HONDA ET AL.

It is certified that error appears in the above-identified patent and that said Letters Patent is hereby corrected as shown below:

COLUMN 4

Line 16, "cross sectional" should read --cross-sectional--.
Line 24, "members," should read --members--.
Line 49, "annual" should read --annular--.

COLUMN 5

Line 14, "liquid clear. A" should read --liquid. The--.
Line 15, "clear" should be deleted.
Line 56, "Then" should read --Then,--.

COLUMN 6

Line 18, "sufficiently" should read --a sufficiently--.
Line 40, "of" should read --for--.
Line 56, "succes-" should be deleted.
Line 57, "sively be produced." should read --be produced successively.--.

COLUMN 7

Line 15, "operation" should read --operation,--.
Line 30, "substrate" should read --substrates--.
Line 46, "an" should read --and--.
Line 54, "are" should read --area--.
Line 56, "an" should read --and--.

UNITED STATES PATENT AND TRADEMARK OFFICE

CERTIFICATE OF CORRECTION

PATENT NO. : 5,575,849

DATED : November 19, 1996

INVENTOR(S) : MITSURU HONDA ET AL.

It is certified that error appears in the above-identified patent and that said Letters Patent is hereby corrected as shown below:

COLUMN 8

Line 1, "polyethylene" should read --polyethylene,--.
Line 52, "slobbery" should read --residual--.
Line 61, "slobbery" should read --residual--.

COLUMN 9

Line 1, "hydrocarbon" should read --hydrocarbon,--.
Line 25, "coat" should read --coats--.
Line 35, "uneven shaped" should read --uneven-shaped--.
Line 63, "levels" should read --levels,--.

COLUMN 10

Line 2, "an" should read --and--.
Line 48, "are" should read --were--.

COLUMN 11

Line 50, "layer 33," should read --layer 63,--.
Line 64, "and when" should read --and, when--.

COLUMN 12

Line 3, "example" should read --example,--.
Line 6, "e" should be deleted.
Line 16, "drums" should read --drum--.
Line 17, "photo-sensitive" should read --photosensitive--.
Line 55, "to provide" should read --the provision of--.
Line 66, "an" should read --a--.

UNITED STATES PATENT AND TRADEMARK OFFICE

CERTIFICATE OF CORRECTION

PATENT NO. : 5,575,849

DATED : November 19, 1996

INVENTOR(S) : MITSURU HONDA ET AL.

It is certified that error appears in the above-identified patent and that said Letters Patent is hereby corrected as shown below:

COLUMN 13

Line 13, "wit" should read --with--.

COLUMN 14

Line 38, "faces" should read --faces,--.
Line 66, "or" should read --for--.

Signed and Sealed this

Sixth Day of May, 1997

Bruce Lehman

*Attest:*

BRUCE LEHMAN

*Attesting Officer*

*Commissioner of Patents and Trademarks*